US007040519B2

(12) United States Patent
Irwin et al.

(10) Patent No.: US 7,040,519 B2
(45) Date of Patent: May 9, 2006

(54) THERMOFORMABLE WEB SUPPORT APPARATUS AND SUPPORT DEVICE FOR A HEATED PLASTIC SHEET

(75) Inventors: Jere F. Irwin, P.O. Box 10668, Yakima, WA (US) 98909-1668; Dale L. Vantrease, Selah, WA (US)

(73) Assignee: Jere F. Irwin, Yakima, WA (US)

( * ) Notice: Subject to any disclaimer, the term of this patent is extended or adjusted under 35 U.S.C. 154(b) by 0 days.

(21) Appl. No.: 10/460,933

(22) Filed: Jun. 12, 2003

(65) Prior Publication Data

US 2004/0251295 A1 Dec. 16, 2004

(51) Int. Cl.
*B29C 17/00* (2006.01)
*B65H 20/00* (2006.01)

(52) U.S. Cl. ..... 226/97.3; 242/615.11; 198/721; 226/196.1; 219/388

(58) Field of Classification Search ..... 242/615.11, 242/97.3; 198/721; 226/97.3, 196.1; 219/388
See application file for complete search history.

(56) References Cited

U.S. PATENT DOCUMENTS

| | | | | |
|---|---|---|---|---|
| 2,967,328 A | | 1/1961 | Shelby et al. | 18/19 |
| 3,664,791 A | | 5/1972 | Brown | 425/156 |
| 4,042,384 A | * | 8/1977 | Jackson et al. | 419/43 |
| 4,101,252 A | | 7/1978 | Brown | 425/394 |
| 4,371,246 A | * | 2/1983 | Siryj | 396/575 |
| 5,773,540 A | | 6/1998 | Irwin et al. | 425/387.1 |
| 5,806,745 A | | 9/1998 | Irwin | 226/74 |
| 5,893,994 A | | 4/1999 | Irwin | 219/388 |
| 6,072,158 A | * | 6/2000 | McNally | 219/388 |
| 6,723,960 B1 | * | 4/2004 | DiMartino et al. | 219/386 |

* cited by examiner

*Primary Examiner*—Kathy Matecki
*Assistant Examiner*—Evan H. Langdon
(74) *Attorney, Agent, or Firm*—Wells St. John P.S.

(57) ABSTRACT

A web conveyor is provided having a frame, a pair of conveyor rails, and at least one sag rail. The pair of conveyor rails is carried by the frame in laterally spaced-apart relation. The pair of conveyor rails is configured to support and convey respective edges of a thermoformable web of plastic material. The at least one sag rail includes a friction-reducing material provided along at least a portion of a top edge of the sag rail. The sag rail is provided between the conveyor rails and extends longitudinally along a web travel path. The sag rail is configured to support a web of material intermediate the conveyor rails. A web support apparatus having one or more of friction-reducing material, local, raised portions, and a temperature regulator is also provided.

24 Claims, 8 Drawing Sheets

THERMOFORMABLE WEB SUPPORT APPARATUS AND SUPPORT DEVICE FOR A HEATED PLASTIC SHEET

TECHNICAL FIELD

This invention pertains to fabrication of plastic products from plastic webs using differential pressure thermoforming apparatus. More particularly, the present invention relates to a web support apparatus and method for limiting sagging of a plastic web of thermoformable material when processing the material through a heating station and into a thermoforming station.

BACKGROUND OF THE INVENTION

Thermoforming lines are used to manufacture and form a variety of plastic, thin-walled articles by processing a continuous web or sheet of thermoformable plastic material. One particular technique involves the use of continuous web, differential pressure, thermoforming machines which encounter a problem wherein the web of thermoformable material is heated after which the material sags at a heating station before it reaches a molding station. When a thin web of thermoformable plastic material is heated in a heat tunnel, the thin web of material has relatively little "hot strength". Typically, a thin web of thermoformable plastic material is clamped along its edges as it is conveyed using a thermoforming conveyor through a heat tunnel and into thermoforming machine. However, the strength of the heated, web of plastic material is typically insufficient to fully support the mid portion of the web.

One technique for limiting sagging of a heated web or sheet of thermoformable plastic material entails the use of longitudinally extending, endless sag bands that are configured to support a mid portion of the web, as disclosed in U.S. Pat. No. 2,967,328. However, sag bands are made from spring steel, and they have been known to break. When a sag band breaks, the steel band creates a risk to downstream machinery as the broken band can be fed into a downstream thermforming press resulting in damage to the press. Additionally, stationary sag bands and wires have also been utilized to support a web of thermoformable plastic material within an oven. However, stationary sag wires have been known to slightly melt into the plastic web of material, leaving blemishes in the surface of the material, which can affect the finished quality of articles formed in the web. Furthermore, the wires have also been known to break, similar to the bands.

Another previously known technique involves the utilization of integral, transversely extending support strips that are formed via a cooling operation in a sheet or web of thermoformable plastic material, as disclosed in U.S. Pat. No. 3,664,791. However, the incorporation of such integral support strips complicates the manufacturing process and can slow it down. Additionally, the strips, which are rigidified, are not completely effective at eliminating sag in all cases.

Even another previous system for inhibiting sagging comprises a sheet support apparatus that utilizes air under pressure within a box that is provided beneath the sheet of thermoformable material in order to float the sheet above the box, as disclosed in U.S. Pat. No. 4,101,252. However, the introduction of a high volume of air against an underside of a web will complicate the uniform thermal heating of the web to a particular desired and uniform temperature. Furthermore, the supply of heated air is interrupted when the web (or sheet) of material is stationary; otherwise, the air might cause chilling of the overlying sheet portion that is being supported thereabove. Such an operation can have a significant negative effect on operating speed because air is compressible and intermittent interruption of the supply of air will take time to support and unsupport the web as the air is supplied and interrupted, respectively.

Accordingly, further improvements are needed to provide a more efficient and effective web support apparatus for delivery of a web of heated thermoformable material through a heat tunnel (or oven) and into a thermoforming machine.

SUMMARY OF THE INVENTION

A web support apparatus and a web conveyor are provided for supporting a relatively thin sheet of continuous, heated thermoformable plastic material where the continuous web (or sheet) is intermittently delivered to an oven (or heat tunnel) and into a thermoforming machine such that the web is intermittently moved from stationary positions that correspond with a footprint within the thermoforming machine to form an array of articles within the continuous web of material. Accordingly, the web moves and stops intermittently, which can tend to increase the friction by imparting static friction between the heated web and the underlying web support apparatus. Accordingly, the web support apparatus incorporates a friction-reducing material along a top edge of the web support apparatus. Secondly, the web support apparatus incorporates a discrete geometry that supports the web at discrete locations. Furthermore, the web support apparatus incorporates a temperature-regulating system within the web support apparatus for regulating temperature of the support structure and friction-reducing material within a desired operating range.

According to one aspect, a web conveyor is provided having a frame, a pair of conveyor rails, and at least one sag rail. The pair of conveyor rails is carried by the frame in laterally spaced-apart relation. The pair of conveyor rails is configured to support and convey respective edges of a thermoformable web of plastic material. The at least one sag rail includes a friction-reducing material provided along at least a portion of a top edge of the sag rail. The sag rail is provided between the conveyor rails and extends longitudinally along a web travel path. The sag rail is configured to support a web of material intermediate the conveyor rails.

According to another aspect, a web support apparatus is provided with a support frame and a sag rail. The sag rail is carried by the frame and includes a friction-reducing material provided along at least portions of a top edge of the sag rail.

According to yet another aspect, a web support apparatus is provided with the sag rail. The sag rail has a top edge with local, raised portions intermittently spaced along the top edge to provide an air flow gap between adjacent pairs of the raised portions.

According to even another aspect, a web support apparatus is provided having a sag rail including a temperature regulator provided in the sag rail According to yet even another aspect, a support device is provided for a heated plastic sheet. The support device includes a thermally-regulated sag rail.

The present invention provides an advantage by reducing static, or start-up, friction between a heated web of thermoformable material and a web support structure when intermittently delivering the web so that the web is stationary, then moving, during an intermittent motion thermoforming operation.

The present invention provides another advantage by increasing uniformity of heat delivery to a web in an oven because the friction-reducing material is elevated above a top edge of a sag rail to provide gaps between the intermittent insert pieces of friction-reducing material. The gaps enhance delivery of heat to the web of material while the web is moved through an oven, or heat tunnel, so as to impart more uniform delivery of heat across and along the web of material.

The present invention provides yet another advantage in that the web is more uniformly heated by enhancing temperature control of the web supporting apparatus. To achieve this, a temperature regulating system is provided for controlling temperature of a friction-reducing material and an accompanying web support rail to maintain the friction-reducing material within a desired and safe temperature operating range within an oven, or heat tunnel, and to regulate temperature of the rail.

BRIEF DESCRIPTION OF THE DRAWINGS

Preferred embodiments of the invention are described below with reference to the following accompanying drawings.

FIG. 4 is a vertical sectional view taken along line 4—4 of FIG. 3 and illustrating a sag rail for the web support apparatus within the web conveyor of FIGS. 1–3, and further illustrating the heat exchanger and control system for controlling temperature of the sag rails;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Reference will now be made to a preferred embodiment of Applicant's invention. An exemplary implementation is described below and depicted with reference to the drawings comprising a web support apparatus and a conveyor having a web support apparatus according to one aspect of the present invention. However, alternative embodiments will be understood and described (where appropriate) with reference to the figures.

While the invention is described by way of the preferred embodiment, it is understood that the description is not intended to limit the invention to this embodiment, but is intended to cover alternatives, equivalents, and modifications which may be broader than this embodiment, such as are included within the scope of the appended claims.

Furthermore, in an effort to prevent obscuring the invention at hand, only details germane to implementing the present invention will be described in great detail. Presently understood peripheral details will be incorporated by reference, as needed, as being presently understood in the art.

Figure 1:
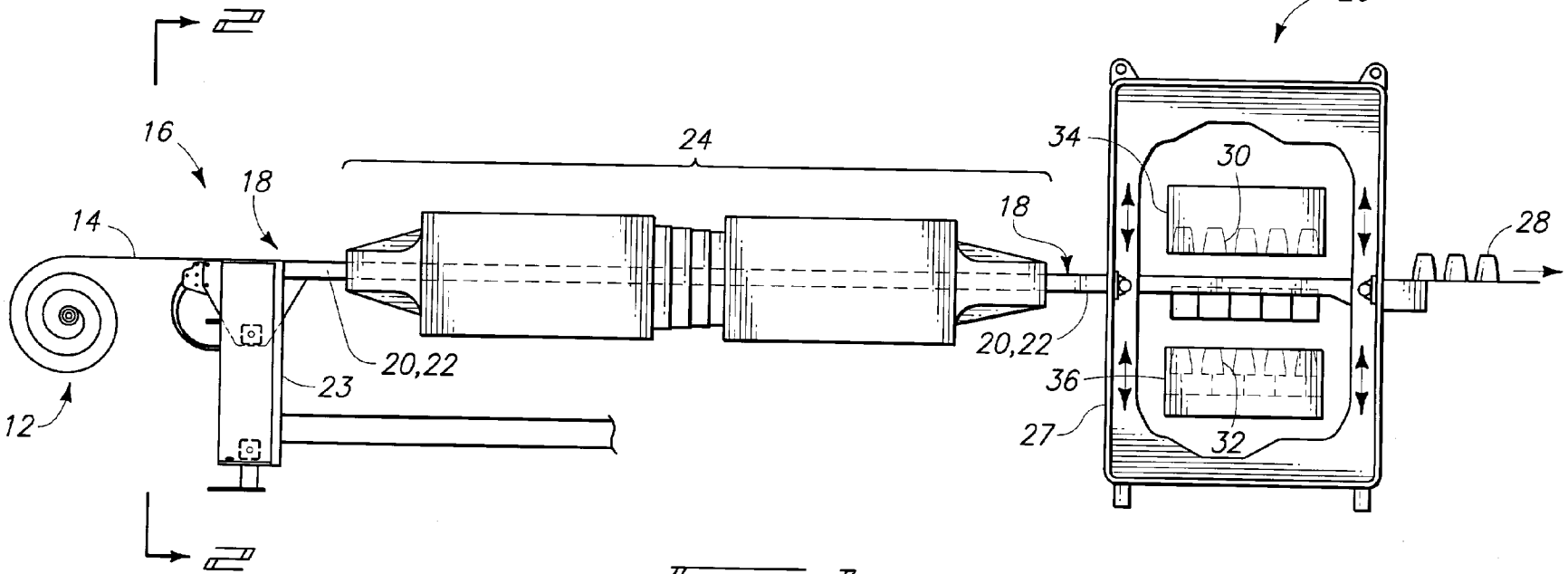
FIG. 1 is a schematic side view representation of a web support apparatus and web conveyor incorporated into a thermoforming line.

A preferred embodiment web support apparatus is first described with reference to FIGS. 1–10 and is identified by reference numeral 18. As shown in FIG. 1, web support apparatus 18 forms one component of a thermoforming line 10. Thermoforming line 10 starts with a delivery roll 12 of thermoformable web material that is carried on a delivery roll support frame (not shown), commonly referred to as a rotary unwind machine. A web (or sheet) of relatively thin, thermoformable plastic or foam material is unrolled from delivery roll 12 as it is conveyed by a chain conveyor 16 through a thermoforming oven (or heat tunnel) 24 where heat is delivered to web 14 to prepare the web to be formed into articles 28 via a thermoforming machine (or former) 26.

Conveyor 16 includes a pair of chain conveyor rails 20 and 22 that each cooperate with a conveyor frame 23 and a former frame 27 to form a frame. The overall frame is carried in laterally spaced-apart relation by frame 27 of former 26 and frame 23 of conveyor 16 in order to support and convey respective lateral edges of thermoformable web 14 of plastic (or foam) material.

As shown, conveyor 16 delivers a web 14 of thermoformable material in a supported manner, via web support apparatus 18, through adjustable thermoforming oven 24 and through thermoforming machine (or former) 26. Oven 24 and former 26 are configured for cycle-based operation, with conveyor 16 delivering web 14 in intermittent increments from delivery roll 12 through oven 24 and into former 26. Web 14 is held stationary during each forming operation within former 26 which causes the intermittent motion. Conveyor 16 is driven by a servo drive motor whose operation is controlled by a system operating computer (not shown).

A machine control system (not shown) is provided in the form of a combination of software and hardware typically provided on a dedicated system control computer to coordinate and control the operation of conveyor 16, oven 24, and former 26. Additionally, a trim press (not shown) and a web recycling machine (not shown) can also be controlled via the same machine control system, and are placed downstream of former 26 to separate formed articles 28 from web 14 and to recycle the remaining web. Likewise, an article stacking and packaging apparatus (not shown) can also be provided downstream of former 26 for stacking and bagging articles 28. It is presently envisioned that any of a number of presently available machine control systems can be utilized for controlling thermoforming line 10, including "Ballerina", presently commercially available from Irwin Research and Development, Inc., of Yakima, Wash. However, alternative machine control systems can include combinations of purely mechanical kinematic linkages. Additionally, conveyor 16 can be optionally constructed and controlled to continuously deliver web 14 through a processing machine at a constant line speed. For example, conveyor 16 can deliver web 14 through a pair of rotary forming and cutting dies which enables continuous feeding of web 14 during forming and cutting operations.

Thermoforming machine (or former) 26 is essentially a thermoforming rotary-driven press. Former 26 is illustrated here in simplified form since the actual construction and operation is not important to operation or implementaton of web support apparatus 18, as long as frame 27 of former 26 supports an exit end of conveyor 16. Former 26 of FIG. 1 has an upper and a lower kinematic drive linkage assembly (not shown) that is configured to support and drive associated upper and lower platens 34 and 36 for forming articles 28 in web 14 after web 14 has been used within oven 24. Upper platen 34 includes a plurality of article cavities 30, and lower platen 36 includes a plurality of complementary, corresponding article plugs 32 that cooperate to form articles 28 as plugs 32 are drawn into complementary cavities 30 during a forming operation. Such details of thermoforming machines (or formers) are presently understood in the art and additional features are not important to the implementation of the present invention. Accordingly, further details have been omitted in order to simplify description of the thermoforming line 10 in order to focus on description of conveyor 16.

In operation, conveyor 16 unwinds and delivers web 14 from storage roll 12, through thermoforming oven 24, and through former 26 where web 14 is molded into articles 28, as depicted in FIG. 1. Former 26 is opened and closed onto heated plastic web 14 by one or more rotary electric servo motor drives configured to drive associated kinematic linkages (not shown) and accompanying dies 34 and 36. In this manner, the plugs 32 and cavities 30 of former 26 cooperate to impart molded features into web 14. In operation, it becomes necessary to choreograph movement of former 26 with conveyor 16 in order to optimize production rate of articles 28 being formed in former 26. For example, conveyor 16 is operated so as to feed web 14 when dies 34 and 36 are separated (or open), allowing feeding of new material from web 14 to be formed within former 26. However, conveyor 16 is stopped when dies 34 and 36 of former 26 are closed together, or nearly closed, during an actual thermoforming step.

Further details of one exemplary construction for conveyor 16 (but omitting the web support apparatus of the present invention) are disclosed in U.S. Pat. No. 5,806,745, entitled "Adjustable Conveyor for Delivering Thin-Web Materials", issued to Jere F. Irwin on Sep. 15, 1998. This U.S. Pat. No. 5,806,745 is incorporated herein by reference.

One suitable construction for thermoforming oven (or heat tunnel) 24 is disclosed in U.S. Pat. No. 5,893,994, entitled "Adjustable Length Heat Tunnel for Varying Shot Lengths", issued to Jere F. Irwin, et al., on Apr. 13, 1999. This U.S. Pat. No. 5,893,994 is incorporated herein by reference.

One suitable construction for thermoforming machine 26 is disclosed in U.S. Pat. No. 5,773,540, entitled "Mold Assembly for Thermo-Forming Machine", issued to Jere F. Irwin, et al., on Jun. 30, 1998. This U.S. Pat. No. 5,773,540 is incorporated herein by reference.

Figure 2:
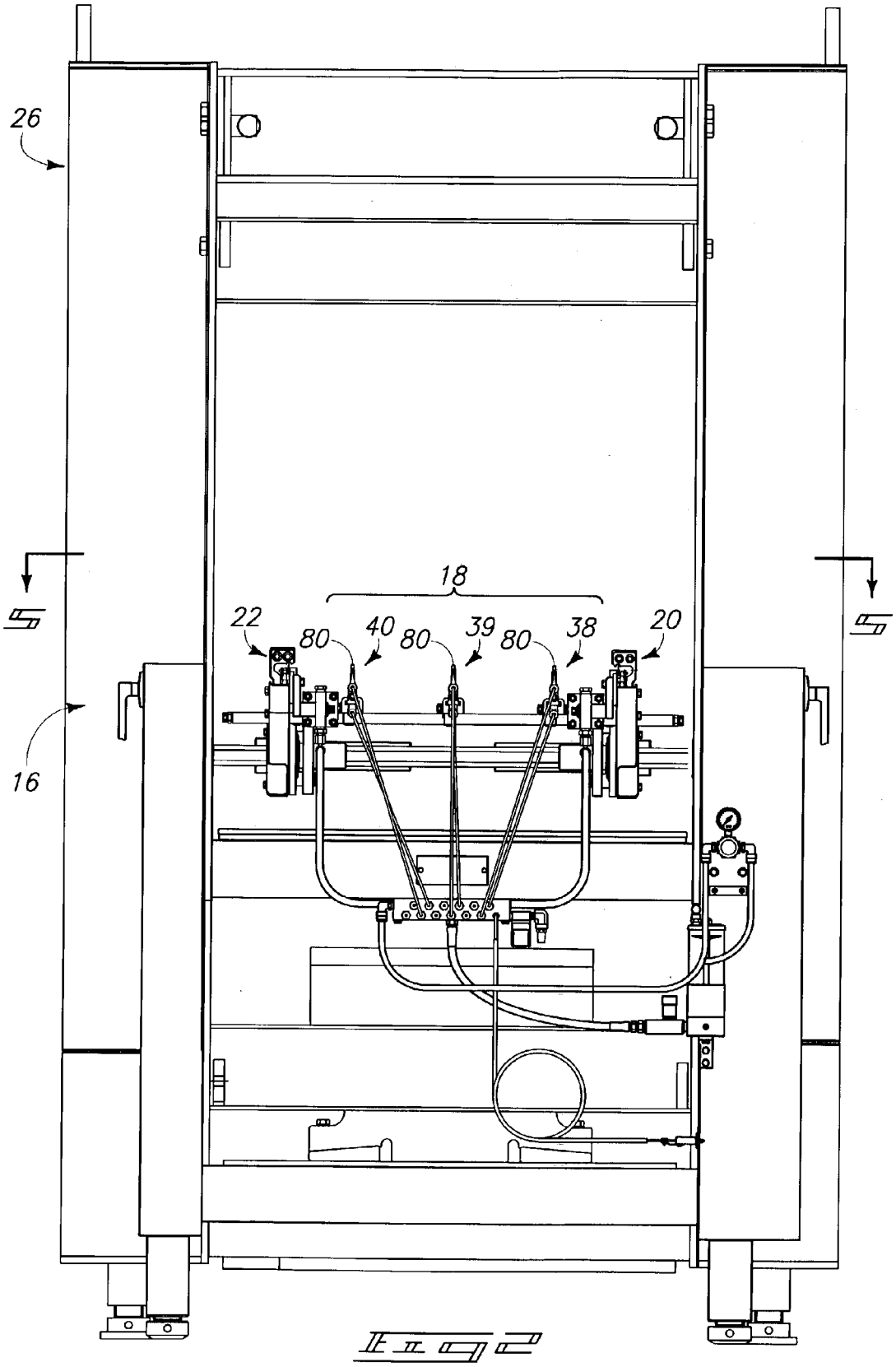
FIG. 2 is a left side and vertical view of the thermoforming line of FIG. 1 taken along line 2—2 of FIG. 1, between a web rotary unwind machine and a web conveyor, looking towards the web conveyor to illustrate the web conveyor and web support apparatus, but omitting the heat tunnel.

FIG. 2 illustrates in end view the configuration of web support apparatus 18 as it is supported and mounted integrally within conveyor 16. More particularly, web support apparatus 18 comprises three individual sag rails 38–40 which are provided in laterally spaced-apart and longitudinally extending relationship between, and parallel with, chain conveyor rails 20 and 22. The relative position can be adjusted by unclamping, moving, and reclamping each sag rail 38–40. A plurality of insert pieces 80 are provided along a top edge of each sag rail 38–40, elevated above the remaining portion of each respective sag rail, and are constructed of a friction-reducing material to reduce friction between a web of material being supported by and traveling therealong as conveyed along lateral edges by conveying chains of chain conveyor rails 20 and 22.

Figure 5:
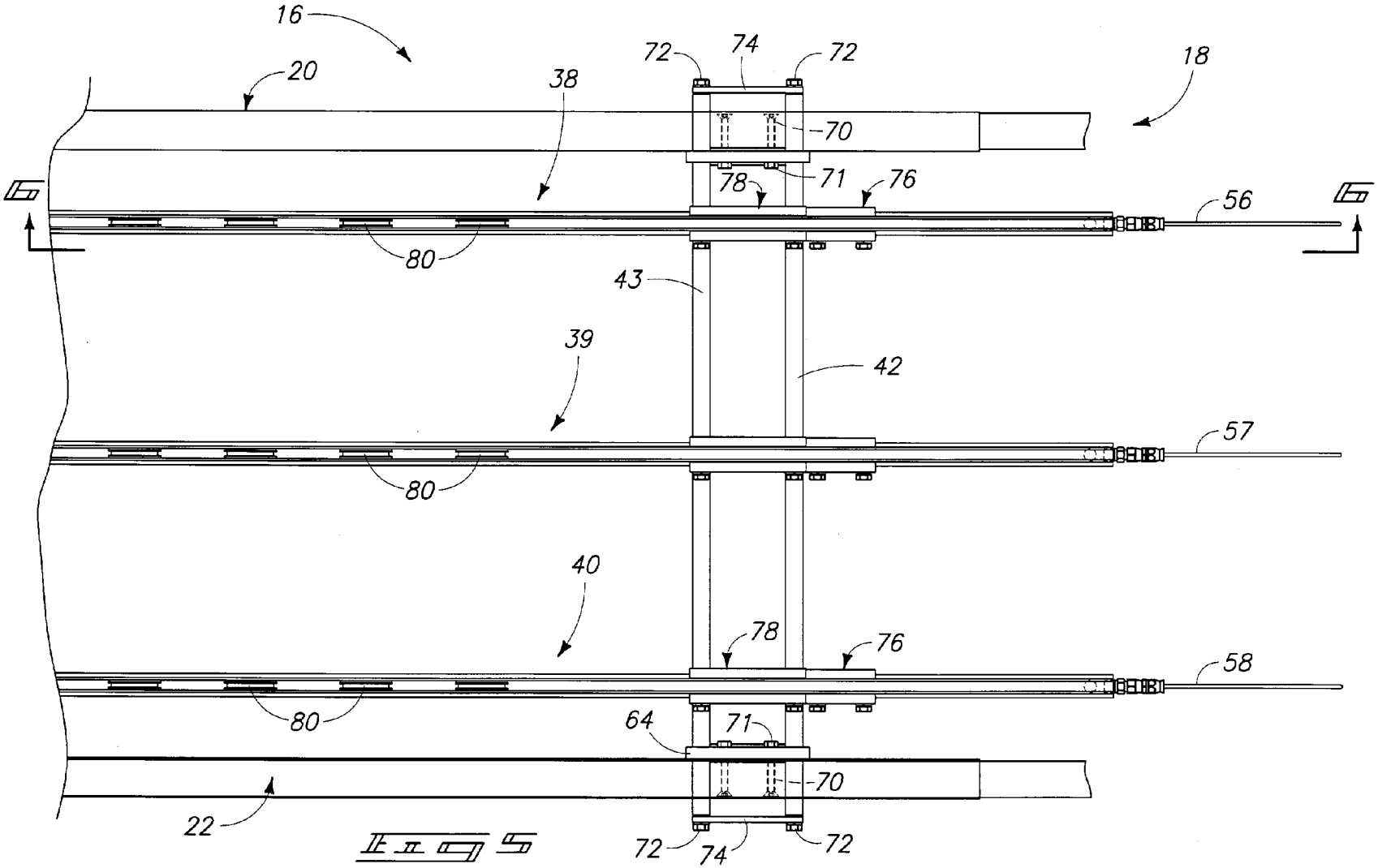
FIG. 5 is a partial plan view of the web conveyor and web support apparatus taken along line 5—5 of FIG. 2.
Figure 9:
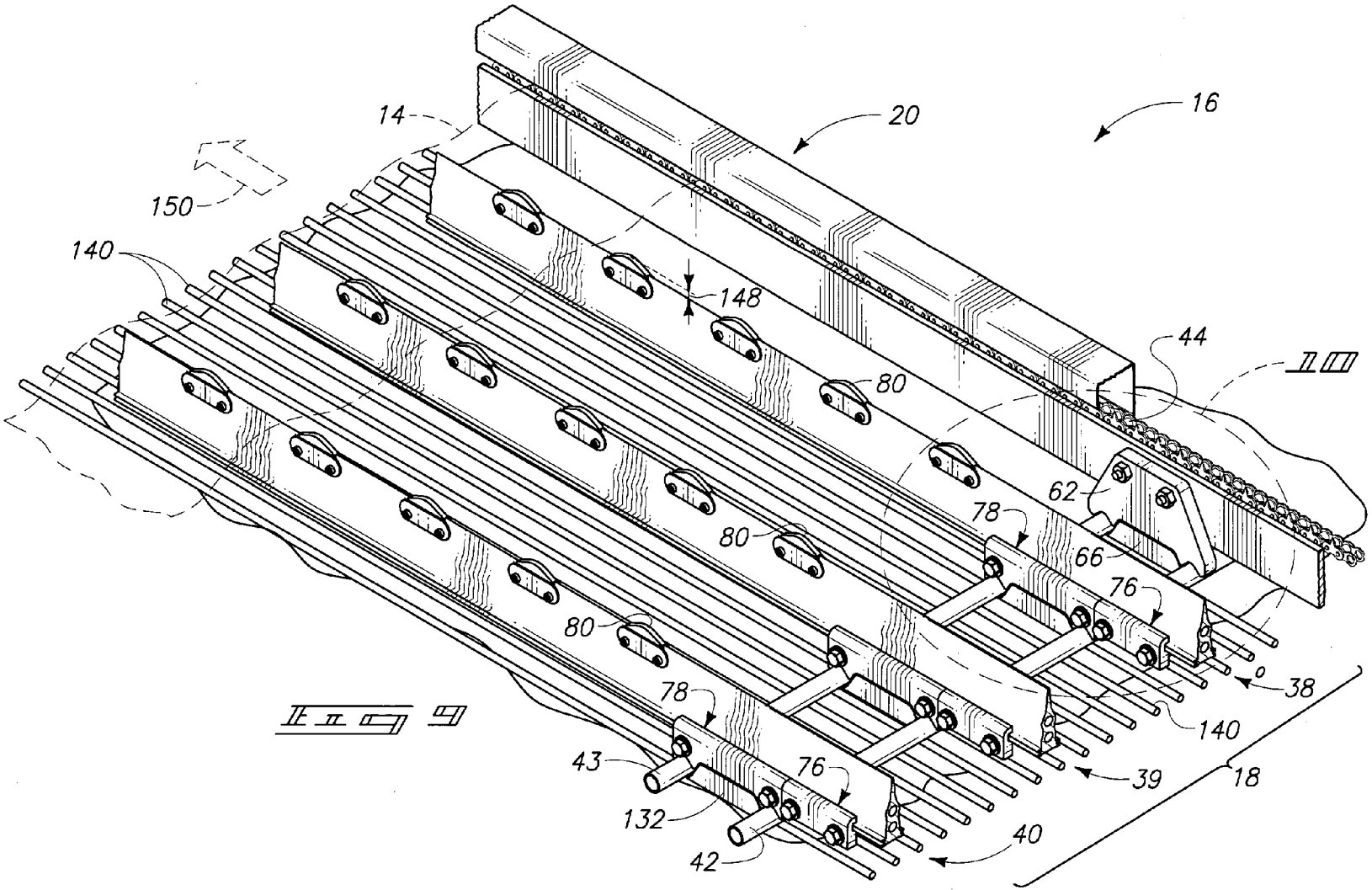
FIG. 9 is an enlarged, partial isometric view taken adjacent an upstream end of a web support apparatus having a plurality of laterally spaced-apart sag rails as provided in the conveyor of FIGS. 1–8.
Figure 10:
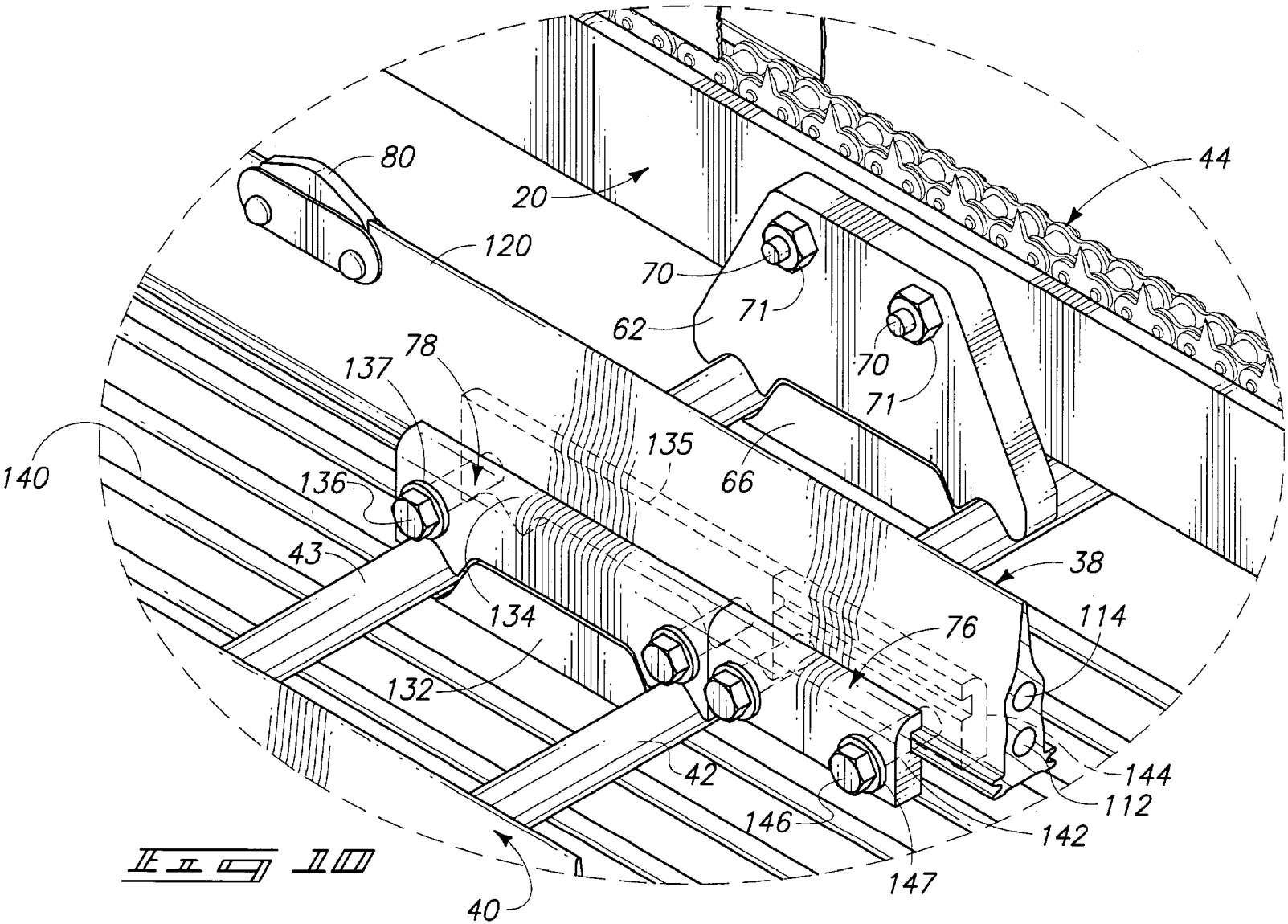
FIG. 10 is an enlarged perspective view taken within the encircled region 10 of FIG. 9 further illustrating the mounting configuration of a sag rail on a conveyor.

As shown in FIG. 2, conveyor chains within rails 20 and 22 draw material along and over sag rails 38–40 to maintain contact with discrete insert pieces 80 so as to reduce contact friction therealong as a web of material (not shown) is conveyed through an oven (not shown) for heating and into thermoforming machine 26 for molding of articles. As shown in enlarged elevational view in FIG. 3, sag rails 38–40 cooperate to provide web support apparatus 18 in a configuration substantially parallel and equally spaced apart between chain conveyor rails 20 and 22. Sag rails 38–40 are each supported at intermittent locations along their length by pairs of retainer bars 42 and 43. Adjacent pairs of retainer bars 42 and 43 are secured together at each end by an end plate 74 that is affixed at each end to a respective one of the retainer bars 42 and 43 using a threaded bolt 72. Further details of such construction for retainer bars 42 and 43 are illustrated in FIGS. 5 and 9–10. Each sag rail 38–40 is affixed in the longitudinal position relative to retainer bars 42 and 43 with a retainer lock 76 and a rail clamp 78 that each clamp in a desired longitudinal position on each sag rail 38–40, respectively, adjacent an upstream end.

As shown in FIGS. 3, 5 and 9–10, pairs of retainer bars 42 and 43 are secured to chain conveyor rails 20 and 22 using chain rail end clamp plates 62 and 64, respectively. As shown in FIG. 5-6 and 8-10, individual rail clamps 78 position each sag rail 38–40 in a specific lateral position between rails 20 and 22 by securing in rigid engagement between retainer bars 42 and 43. However, each sag rail can axially slide within additional, similar rail clamps 178 which are provided in spaced-apart relation downstream from rail clamps 78 at an upstream end. Rail clamps 178 differ from upstream rail clamps 78 in that rail clamps 78 have a T-shaped slot that compresses and secures to clamp onto a corresponding base flange on the sag rail 38–40 to affix rail clamp 78 at a specific axial location along the sag rail. In contrast, rail clamps 178 have a slightly larger sized T-shaped slot which, after bolting together the rail clamp 178, the remaining T-shaped slot enables axial sliding of the sag rail 38–40 within the rail clamp 178 so as to enable thermal expansion and contraction of the rail member. Accordingly, remaining rail clamps 178 are spaced apart downstream of rail clamps 78 so as to laterally affix and position each respective sag rail 38–40, but allow for axial sliding to provide for a thermal expansion and contraction of rail member 120.

Figure 6:
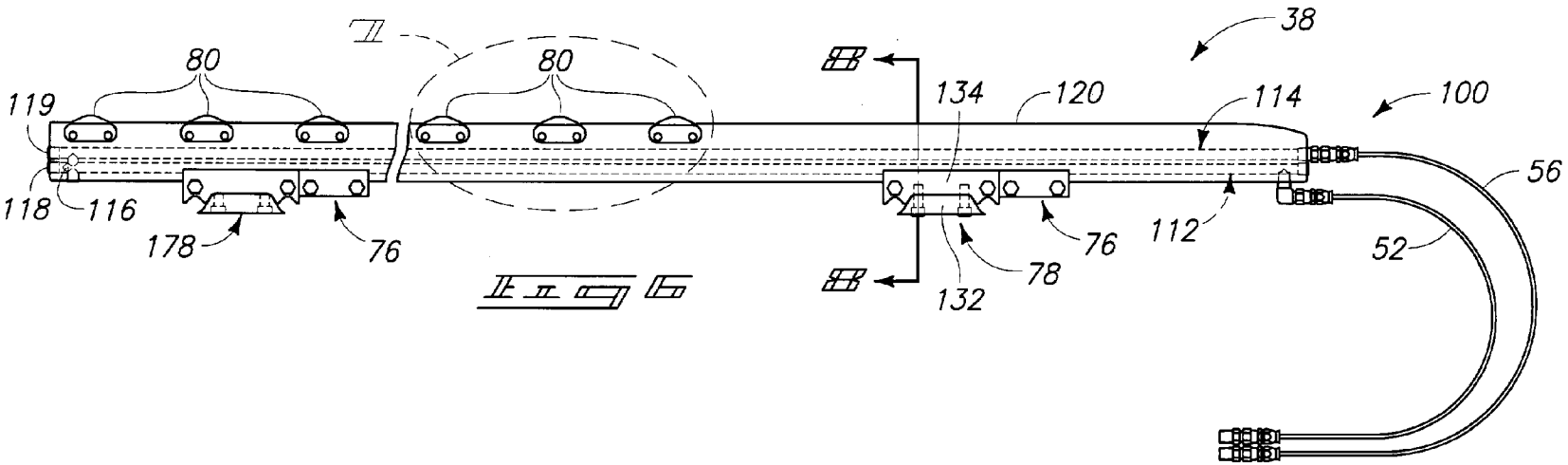
FIG. 6 is a vertical view of one sag rail taken along line 6—6 of FIG. 5, but eliminating remaining portions of the web conveyor.

As shown in FIG. 6, a plurality of retainer locks 76 are also clamped securely onto the base flange of rail member 120 of the sag rail 38 to further secure the sag rail along a conveyor within an oven. More particularly, a retainer lock 76 is clamped onto rail member 120 immediately adjacent and upstream of each respective rail clamp 78 and 178. In this manner, if rail clamp 78 loosens and rail member 120 is inadvertently allowed to slide axially downstream, retainer locks 76 will prevent rail member 120 from migrating in a downstream direction (which will tend to happen because of frictional forces acting on insert pieces 80 as a web is transferred there across). Such additional fixation provides a safety feature because migration of rail member 120 in a downstream direction would result in rail member 120 being deposited between dies of a thermoforming machine which could result in a significant amount of damage and destruction to the thermoforming machine and thermoforming line. Hence, retainer locks 76 provide a safety feature which prevents inadvertent downward migration of rail members 120 on each sag rail 38–40.

Figure 3:
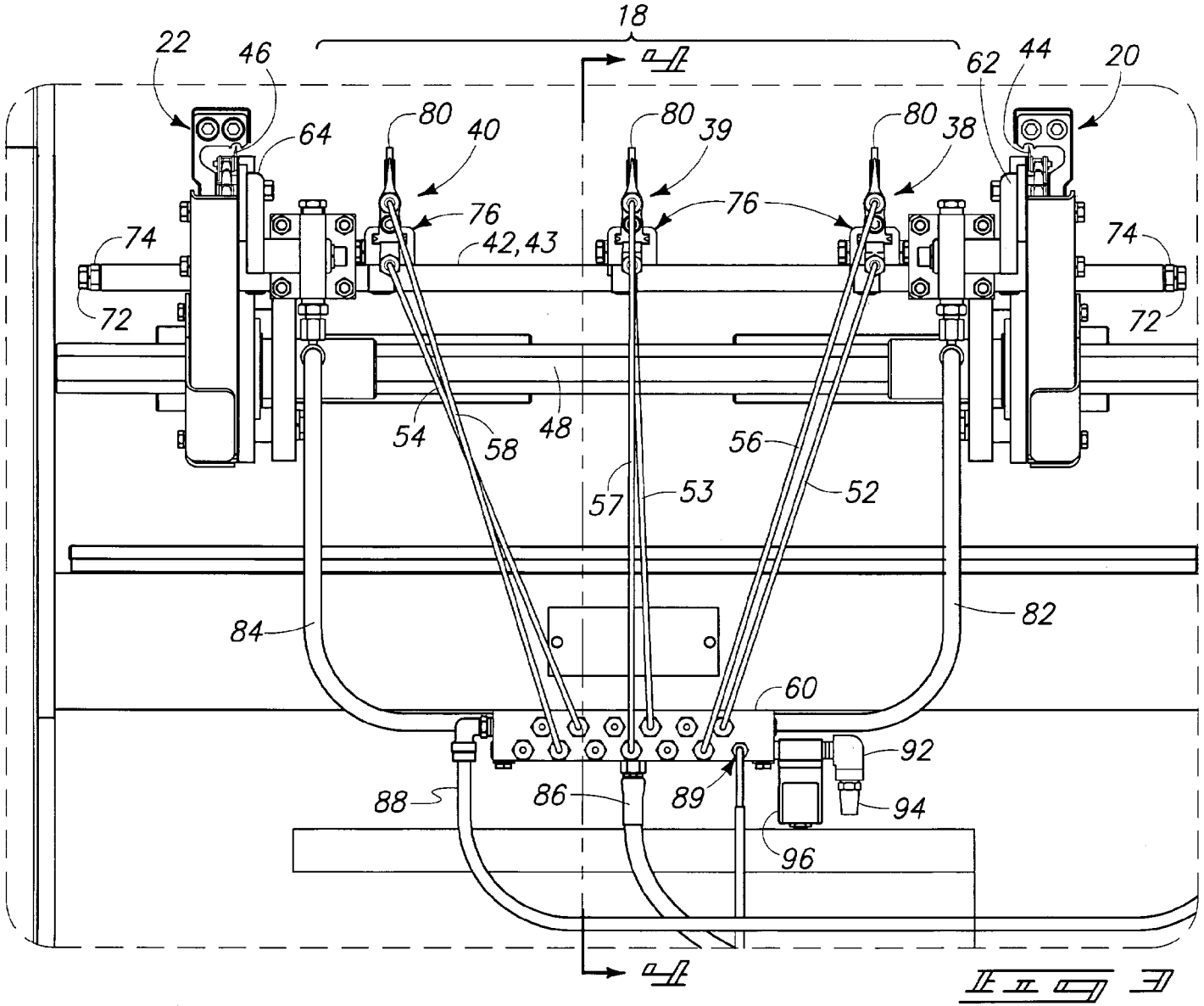
FIG. 3 is an enlarged view of the encircled region 3 of FIG. 2, illustrating in greater detail the web conveyor and web support apparatus of FIGS. 1–2.
Figure 11:
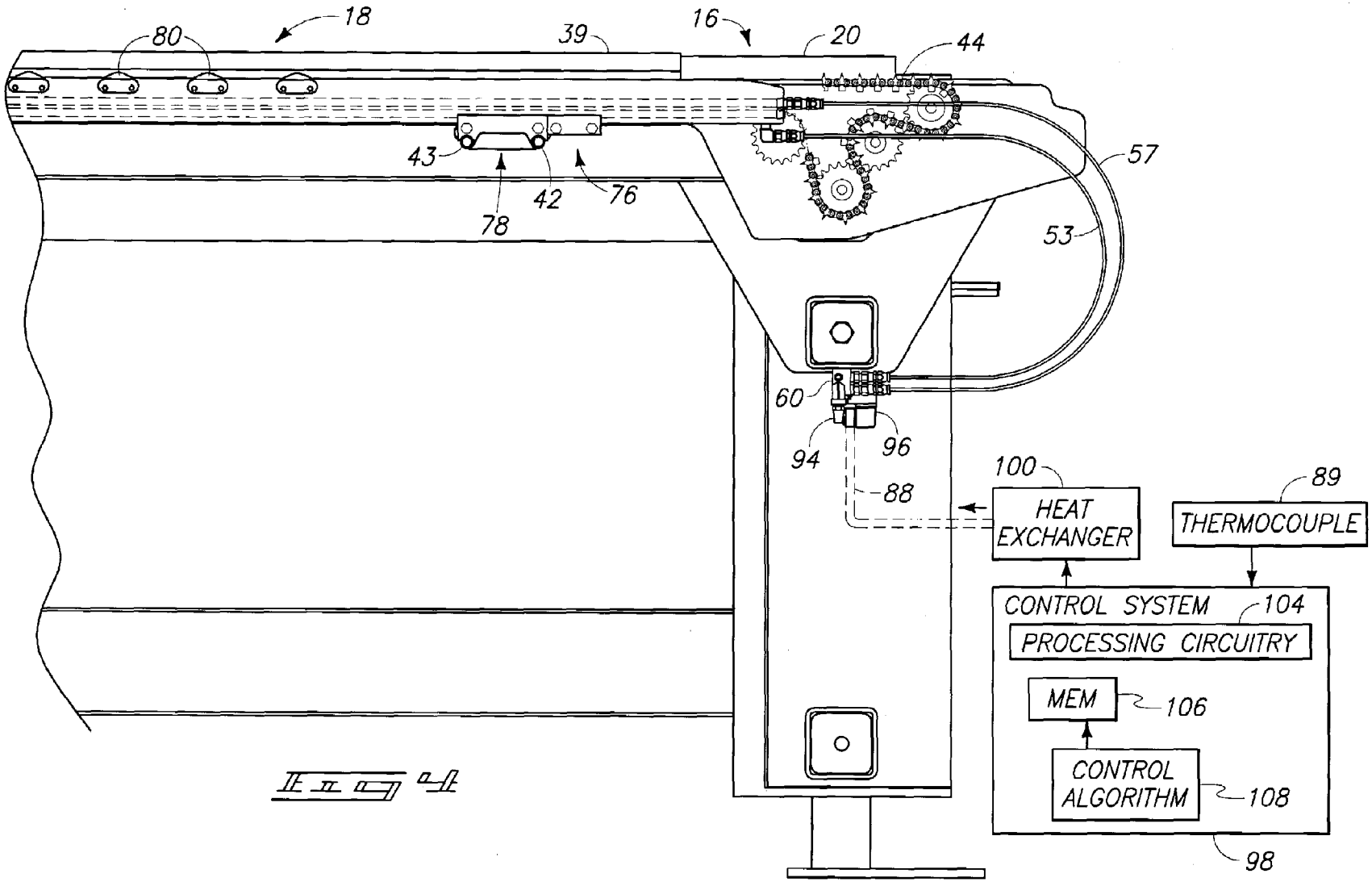

As shown in FIGS. 3–4 and 6, sag rails 38–40 each receive a flow of temperature-regulated fluid in order to regulate temperature for the respective sag rail, and more particularly, to control the maximum operating temperature for each low-friction insert piece 80 when operating within an oven. As shown in FIG. 3, inlet hoses 52–54 and outlet hoses 56–58 are connected to an upstream end of each sag rail 38–40, respectively. Inlet hoses 52–54 receive a supply of temperature-regulating fluid from a manifold 60; whereas outlet hoses 56–58 deliver the fluid back to manifold 60 where the fluid is ejected via an elbow 92 through an outlet muffler 94 (where the fluid is air) in response to opening of a solenoid 96. A fluid supply line 88 provides a supply of temperature-regulated fluid, such as cooled (or heated) air, to manifold 60 for delivery through inlet hoses 52–54 down sag rails 38–40, respectively, and back through outlet hoses 56–58 for ejection through outlet muffler 94 to ambient atmospheric pressure.

In one case, the supply of temperature-regulated fluid is air that is heated to a specific temperature. Such temperature-regulated fluid is pumped through the respective sag rail in order to elevate the temperature of the sag rail at start-up of the thermoforming line and oven. Once the oven has reached a desired operating temperature, the, temperature-regulated fluid (or air) may be cooled air that is delivered in a metered manner through the sag rail in order to maintain the sag rail temperature within a desired range which is below the operating temperature of the oven. Hence, in this case the air is used as a cooling fluid to reduce the temperature of the sag rail and to particularly reduce the operating temperature of the friction-reducing insert pieces. For the case where the friction-reducing insert pieces 80 comprise polytetrafluoroethylene (or Teflon™), the Teflon™ has a desirable maximum operating temperature, such as 350 degrees Fahrenheit. However, a thermoforming oven may have heater elements that run in the 600–900 degree Fahrenheit temperature range. Accordingly, once the oven and conveyor are up to an operating temperature and desired steady state operating speed, it may be desirable to effectively cool the sag rail and insert elements to a desired acceptable operating temperature range particularly if the oven temperature exceeds a maximum allowable temperature for Teflon™.

Also shown in FIG. 3, a web of thermoformable plastic material (not shown) is edge-supported and moved by chains 44 and 46 within chain conveyor rails 22 and 24, respectively, so as to be drawn taut across insert pieces 80 of sag rails 38–40. In this manner, a heated web (or sheet) is supported to travel through an oven and into a former. Chains 44 and 46 have intermittent perforating fingers that pierce the web at intermittent locations so as to hold and convey the web therealong. Chains 44 and 46 are also tightened utilizing a chain tightening system (not shown) that is supplied with hydraulic fluid via chain tension or hydraulic feed lines 82 and 84 that are commonly fed from a main hydraulic feed line 86. A common hexagonal shaft 48 is configured to drive chains 44 and 46 via sprockets (not shown), as taught in U.S. Pat. No. 5,806,745, previously incorporated herein by reference.

A thermocouple (or temperature sensor) 89 is also provided within manifold 60 for detecting temperature of fluid leaving sag rails 38–40 via outlet hoses 56–58. Optionally, thermocouple 89 can be located within one or more sag rails 38–40. A thermocouple lead 90 from thermocouple 89 provides an input signal to a rail temperature control system 98 of FIG. 4.

As shown in FIG. 4, sag rails, such as sag rail 39, receive an inlet supply of temperature-regulating fluid via lower inlet hose 53 and ejects the fluid, after temperature regulating the sag rail 39, via upper outlet hose 57. In this manner, low-friction insert piece 80 is kept within a desired temperature range at its mounting location on sag rail 39.

Each inlet hose, such as inlet hose 53 (of FIG. 4), receives a supply of temperature-regulating fluid in a controlled and regulated manner via fluid supply line 88. According to one construction, where the temperature-regulating fluid is cooled, a heat exchanger 100 is used to cool the supply of fluid, such as air, in response to computer-controlled rail temperature control system 98. Alternatively, the fluid is heated (e.g., at start-up). Control system 98 receives input from thermocouple 89 which senses temperature of fluid leaving the respective sag rail. According to one construction, a fan is used to drive air through the heat exchanger to transfer heat between the heat exchanger and the air. In one case, the heat exchanger cools the air to a desired temperature. In another case, the heat exchanger heats the air to a desired temperature.

Control system 98 of FIG. 4 includes processing circuitry 104 and memory 106. A control algorithm 108 is stored within memory 106 and processed via processing circuitry 104 in order to implement control of heat exchanger 100 to deliver a desired temperature of fluid via supply line 88 to each sag rail, such as sag rail 39. In this manner, a desired cooling (or heating) is provided to sag rail 39 and insert pieces 80. Optionally, the rate of fluid flow can be adjusted to control the temperature of the sag rails. Further optionally, the flow can be pulsed between "on" and, "off". For example, the flow of room temperature air can be intermittently "pulsed" through each sag rail. Even further optionally, the fluid can be water, oil or even radiator fluid. In this case, a closed-loop fluid circuit is used, and heat exchanger 100 is provided in the circuit.

Control system 98 regulates the operation of heat exchanger 100 via control algorithm 108, either based upon a feedback signal from thermocouple 89 or based upon a predetermined value stored in memory, to regulate temperature of temperature-regulating fluid within a desired range. In one case, the fluid temperature is controllably regulated between a minimum and maximum value. In another case, the temperature of the fluid is regulated below a maximum value. In yet another case, the temperature is regulated above a minimum value. In an even further case, the temperature is held at a target value, within a predetermined differential temperature tolerance range. For example, the fluid can be held within a range of 300–375 degrees Fahrenheit. Other examples are also possible.

As shown in FIG. 6, each sag rail 38–40 is similarly constructed and sag rail 38 is illustrated for purposes of showing the flow of temperature-regulated fluid that is delivered by way of the control system of the present invention to regulate temperature of sag rail 38. More particularly, inlet hose 52 delivers fluid into a lower cooling cavity 112 of an extruded aluminum rail member 120 of sag rail 38. By way of a bridge cooling cavity 116, fluid travels from lower cooling cavity 112 up to upper cooling cavity 114. Accordingly, a temperature-regulating (either cooling or heating, or both) fluid circuit 110 is provided by the combination of lower cooling cavity 112, bridge cooling cavity 116, and upper cooling cavity 114 extending as a circuit through extruded rail member 120. To facilitate construction, a pair, of threaded and sealed plugs 118 and 119 are provided at the downstream ends of cooling cavities 112 and 114, respectively, adjacent bridge cooling cavity 116.

As shown in FIG. 5, a single pair of retainer bars 42 and 43 are shown affixed between rails 20 and 22. However, it is understood that a plurality of pairs of retainer bars 42 and 43 are spaced apart longitudinally along rails 20 and 22 in order to support sag rails 38–40 in multiple locations. Typically, pairs of retainer bars 42 and 43 are spaced approximately eight feet apart along the length of conveyor 16. More particularly, an upstream end of sag rails 38–40 are each supported by way of rail clamp 78 which laterally and longitudinally affixes each sag rail 38–40. Additionally, retainer lock 76 is rigidly affixed at an axial location on each sag rail 38–40 and prevents axial movement of the respective sag rail as it abuts against rail clamp 78. Similar rail clamps 78 are provided upstream of rail clamps 178.

Retainer bars 42 and 43 are held in a precise spaced-apart relation by securing an end plate 74 at each end using a pair of threaded bolts 72 that thread into a threaded bore in each end of each retainer bar 42 and 43. A respective clamp plate 62 and 64 is provided adjacent each end. Clamp plate 62 supports bars 42 and 43 by receiving a retainer bar clamp plate 66 therebelow via a pair of threaded fasteners (not shown) (see FIG. 10) that pass through a clearance bar in clamp plate 62 and thread into a hidden, threaded bore in each clamp plate 62 and 64. Each plate 62 and 64 is secured to a respective rail 20 and 22 using a pair of recessed-head fasteners 70 and nut 71. Such mounting is also illustrated in FIG. 10. When the distance between rails 20 and 22 is adjusted laterally, clamp plate 66 is loosened from clamp plate 62 (by loosening the threaded fastener) such that rail 20 can be moved outwardly along retainer bars 42 and 43 (as shown in FIG. 10) and reclamped. Accordingly, clamp plate 66 provides a lower clamp plate that cooperates with clamp plate 62 that provides an upper clamp plate.

Figure 8:
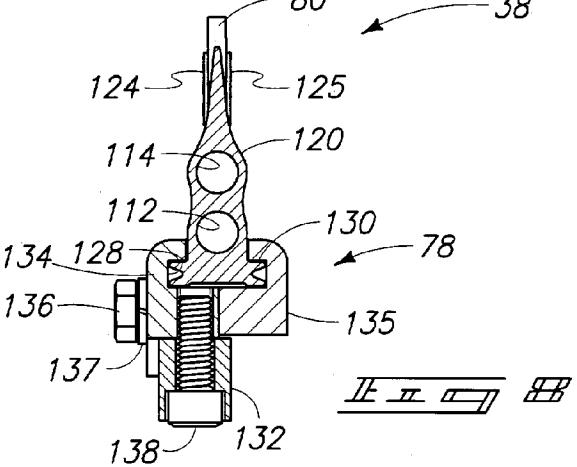
FIG. 8 is a vertical sectional view taken along line 8—8 of FIG. 7 illustrating a supported configuration of a sag rail within a rail clamp as taken along line 8—8 of FIG. 6.

As shown in FIG. 10, clamp plate 66 is constructed similar to retainer bar clamp plate 132 of FIGS. 6 and 8, wherein a fastener similar to fastener 138 is used to clamp and unclamp clamp plate 66 relative to plate 62 so as to rigidly secure and release rail clamps 78 and 178 against retainer bars 42 and 43.

As shown in FIG. 8, the spaced-apart configuration of sag rails 38–40 and the longitudinally spaced-apart configuration of low-friction insert pieces 80 provide support for a web of thermoformable material as it passes through an oven and into a former for processing of articles in the web.

FIG. 6 also illustrates the placement of an upstream rail clamp 78 and an adjacent, upstream retainer lock 76 along extruded rail member 120. At least one additional rail clamp 178 is provided at a downstream location along extruded rail member 120 for clamping to a similar pair of retainer bars (not shown). Optionally, another retainer lock 76 is provided adjacent and upstream to rail clamp 178 at the downstream location(s). Rail clamps 78 are rigidly affixed at longitudinal locations along rail member 120; whereas rail clamps 178 laterally secure member 120, but enable axial sliding therealong.

As shown in FIG. 8, rail clamp 78 comprises a pair of rail clamp members 134 and 135 and a lower clamp plate 132. Rail clamp 78 is released for adjustment along the retainer bars (not shown) by separating clamp plate 132 from rail clamp member 134. Separation is achieved by releasing fasteners 138 which pass through a clearance bar in clamp plate 132 and thread into a hidden, threaded bore in rail clamp member 134 contained therebetween. By tightening such fasteners, clamp plate 132 is driven toward rail clamp members 134 and 135 so as to trap (or clamp) retainer bars that are provided therebetween at either end.

Figure 7:
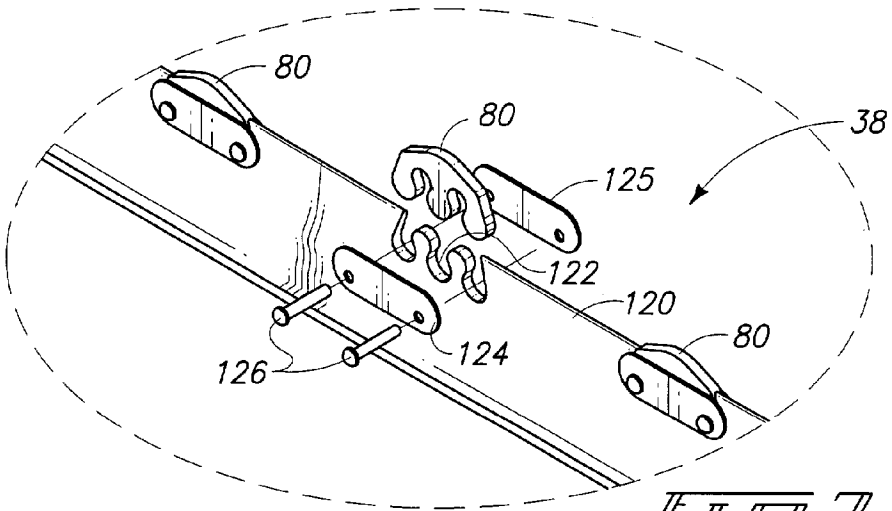
FIG. 7 is an enlarged isometric view taken within the encircled region 7 of FIG. 6 illustrating insert pieces of friction-reducing material supported in spaced-apart relation along the sag rail.

FIG. 7 illustrates in greater detail the placement and mounting of individual low-friction insert pieces 80 along extruded rail member 120. More particularly, a plurality of serpentine receiving apertures 122 are machined transversely through extruded rail member 120, along a top edge. Serpentine receiving aperture 122 is formed in complementary relation to receive a serpentine-shaped bottom portion provided on the bottom of insert piece 80. Accordingly, insert piece 80 is received in a lateral direction into serpentine receiving aperture 122, after which a pair of elliptical, or oblong, plates 124 and 125 are mounted together on either side of insert piece 80. More particularly, aluminum rivets 126 are used to entrap insert piece 80 on either side by plates 124 and 126. Plates 124 and 126 are slightly larger than a base portion of insert piece 80 so as to expand the outer bounds of receiving aperture 122. Accordingly, low-friction insert piece 80 is retained within receiving aperture 122 by the sandwiched (and assembled) action of plates 124 and 125.

Also shown in FIG. 7, each low-friction insert piece 80 extends elevationally above a top edge of rail member 120 so as to elevate a web thereabove. Elevated insert pieces 80 provide for passage of hot air and gases between adjacent insert pieces 80 along a common rail member 120 so as to more evenly and fully heat a sheet of thermoformable material being supported thereabove. In this manner, rail members 120 do not provide a complete lateral baffle under the web that prevents lateral transfer of heat from one side of rail member. 120 to another side of rail member 120 as a web is provided thereabove.

According to one construction, low-friction insert piece 80 is formed from polytetrafluoroethylene (otherwise known as Teflon™, of E.I. du Pont de Nemours and Company). Optionally, other relatively low-friction insert pieces can also be provided as long as a coefficient of friction for insert piece 80 is less than that for rail member 120. Optionally, rail member 120 can be partially or completely coated or encased n such a friction-reducing material. Further optionally, extruded rail member 120 can be formed with elevated bumps, after which a polytetrafluoroethylene (or other low-friction) coating is applied there atop. The material of the insert piece 80 has a low coefficient of static and dynamic friction than does the underlying material of extruded aluminum rail member 120.

Even though it is advantageous to provide insert pieces 80 elevationally above rail member 120, it is not necessary. Accordingly, rail member 120 can have a relatively low-friction coating or insert piece provided there atop which has an elevationally uniform configuration extending along a length of rail member 120.

FIG. 8 further illustrates the entrapped mounting of insert piece 80 atop extruded rail member 120 using steel (or metal) plates 124 and 125 as entrapment washers. Plates 124 and 125 are slightly larger than a base portion of serpentine receiving aperture 122 which traps insert piece 80 atop rail member 120. Additionally, lower cooling cavity 112 and upper cooling cavity 114 are shown extending axially through rail member 120.

Also shown in FIG. 8, rail clamp 78 includes two rail clamp members 134 and 135 that cooperate, when assembled together, to form a T-shaped elongated slot 128 sized to receive a base flange 130 of rail member 120 in relatively conforming, but slidable axial relationship. A threaded fastener 136 secures rail clamp members 134 and 135 together a fixed distance so as to provide a slightly under-sized T-shaped slot 128 that longitudinally entraps base flange 130 of extruded rail member 120. More particularly, a clearance bore is provided through rail clamp member 134 for fastener 136. Likewise, a hidden, threaded bore is provided into rail clamp member 135. Accordingly, threaded engagement of fastener 136 with the threaded bore in rail clamp member 135 drives clamp members 134 and 135 together so as to longitudinally affix extruded rail member 120 along rail clamp 78 (and associated retainer bars). In contrast, rail clamps 178 are machined to have a slightly wider T-shaped slot 128 than is found in rail clamp 78. Accordingly, extruded rail member 120 is secured laterally from movement by rail clamps 178. However, axial translation is allowed between extruded rail member 120 when rail clamp 178 is assembled thereabout because base flange 130 is slightly smaller than T-shaped slot 128. Hence, thermal expansion and contraction of member 120 can be accommodated while still laterally retaining member 120 along a conveyor at downstream locations from rail clamp 78. Optionally, rail clamp 78 can be provided at a midstream location or downstream location along extruded rail member 120, with remaining locations utilizing rail clamps 178. Accordingly, thermal expansion will be allowed in different directions according to such alternative placements of rail clamps 78 or 178.

FIG. 9 illustrates in partial isometric view a breakaway portion of conveyor 16 showing a web 14 being conveyed downstream along a web travel path 150 through an oven (not shown). As shown herein, web support apparatus 18 comprises laterally spaced-apart and axially extending sag rails 38–40. Sag rails 38–40 extend within an oven relative to oven heating rods 140 which can be arranged either axially or transversely (or both) of sag rails 38–40.

Although a single pair of retainer bars 42–43 is shown in FIG. 9, it is understood that additional pairs are provided downstream along sag rails 38–40 and between rails 20 and 22 (see FIG. 5). In operation, a respective chain 44 on each rail 20 (and 22, see FIG. 5) pierces a respective edge on a web of thermoformable material, carrying the web in a downstream direction over elevated low-friction insert pieces 80 of sag rails 38–40. Accordingly, individual gaps 148 are provided between adjacent insert pieces 80 along each respective sag rail 38–40 so as to provide for transverse passage of gases and heat which traverse over the respective sag rails 38–40. Hence, more uniform heating is provided to a web within an oven in which web support apparatus 18 is provided. Furthermore, the low-friction nature of insert pieces 80 reduces static friction which intermittently occurs as a web of thermoformable material is stopped and moved intermittently during a thermoforming operation. Hence, the static friction that occurs at start-up when the web is again moved intermittently is significantly reduced by the relatively low friction provided by insert pieces 80. Hence, an accelerated operating speed is provided for a thermoforming line and more controllable moving conditions are imparted to a web when using web support apparatus 18.

During development, testing was performed on a sag rail having a substantially uniform elevational top surface, but without having a friction-reducing, or relatively low friction top portion. During such testing, a shear effect was created between the chain rails 20 and 22 (also see FIG. 2) when a heated web of plastic material is stopped during an intermittent thermoforming operation, after which chain rails 20 and 22 are suddenly driven forward. Static friction buildup between the heated web and the intermediate sag rails was found to cause a shearing effect within the web which tended (in some cases) to produce wrinkles and undesirable surface finish effects in the web of heated thermoformable plastic (or foam) material. Accordingly, testing and development led to the improvements presented herein.

FIG. 10 illustrates in greater detail the mounting of one selected sag rail 38 to a pair of retainer bars 42 and 43 within an oven. As shown in FIG. 10, rail clamp members 134 and 135 are joined together via a pair of threaded hexagonal-head fasteners, or bolts, 136, each with a lock washer 137. Fasteners. 136 extend through a clearance bore in member 134 and into a threaded hidden bore in member 135 so as to draw together members 134 and 135 to laterally and axially affix rail member 120 relative to retainer bars 42 and 43. Similarly, retainer bar clamp plates 66 and 132 each have a pair of vertical clearance bores that align with hidden, threaded bores in clamp plate 62 and clamp member 134, respectively, which enables clamping of clamp plates 66 and 132 toward claim plate 62 and clamp member 134 so as to entrap retainer bars 42 and 43 therebetween in rigidly affixed engagement. Additionally, retainer lock 76 rigidly clamps to the base flange of rail member 120 by securing a pair of threaded fasteners 146 (and lock washers 147) through a pair of clearance holes in retainer lock member 142 into blind, threaded bores provided in retainer lock member 144. Accordingly, threading of fasteners 146 into the bores of member 144 drive together members 142 and 144 so as to rigidly clamp onto the bottom flange of rail member 120. In this manner, retainer lock 76 provides a safety lock that prevents downstream migration of rail member 120 that might otherwise be caused by frictional drag of the web as it moves over the sag rail in a downstream direction. More particularly, retainer lock 76 will physically abut against rail clamp 78 so as to prevent further downward migration of member 120.

When mounting retainer locks 76 along member 120, it is not necessary that retainer locks 76 be provided in direct physical abutment with rail clamps 78 (as well as rail clamps 178). There can be provided slight gaps which further provide room for expansion and contraction of the rail member 120 as it passes through a heated oven which can impart dimensional changes to related components within the web support apparatus and conveyor.

In compliance with, the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A thermoformable web support apparatus, comprising:

a support frame;

a pair of conveyor guide rails carried by the frame and configured to support opposed edges of a thermoformable web;

a support bar having a top edge extending in a longitudinal direction along the web and configured to support the web along a medial margin spaced from the pair of conveyor guide rails to provide a transverse space between the support bar and each guide rail for passage of a longitudinal section of the web into which articles are to be thermoformed into the web; and a temperature regulator provided in the support bar.

2. The thermoformable web support apparatus of claim 1 wherein the temperature regulator comprises a fluid channel provided within the support bar and configured to receive a flow of temperature-regulating fluid to regulate temperature of the support bar within a determined range.

3. The thermoformable web support apparatus of claim 2 wherein the fluid channel comprises a lower fluid channel, an upper fluid channel, and a bridge fluid channel all communicating together to provide a fluid channel circuit through an inside of the support bar.

4. The thermoformable web support apparatus of claim 2 further comprising a heat exchanger communicating with the fluid channel via a conduit and configured to regulate temperature of fluid being delivered through the fluid channel.

5. The web thermoformable support apparatus of claim 4 further comprising a control system configured to control heat transfer between the heat exchanger and the fluid to realize a desired temperature of the fluid.

6. The thermoformable web support apparatus of claim 5 further comprising a temperature sensor provided in communication with the downstream end of the fluid channel and the support bar and configured to monitor temperature of fluid exiting the fluid channel from the support bar, the control system configured to receive an output signal from the temperature sensor to provide feedback control of the heat exchanger in response to detected temperature of fluid leaving the fluid channel.

7. The thermoformable web support apparatus of claim 4 wherein the fluid comprises air.

8. A support device for a heated plastic sheet, comprising:

a support frame;

a pair of edge guide rails carried by the frame and provided on opposed edges of a heated plastic sheet extending in a longitudinal travel direction of the sheet;

a thermally-regulated sag rail carried by the frame between the pair of guide rails and extending in the longitudinal travel direction of the sheet having a top edge configured to contact and support the sheet along a contact line extending along the longitudinal travel direction of the sheet and further providing a longitudinally extending void on each side of the sag rail between the sag rail and each of the guide rails to provide an unblemished longitudinally feed strip of the heated plastic sheet on either side of the sag rail for delivery to a thermoforming machine to form articles within the heated plastic sheet.

9. The support device of claim 8 wherein the sag rail includes a fluid conduit provided within the sag rail and configured to receive a flow of thermally-regulated fluid to transfer heat between the sag rail and the fluid in order to regulate temperature of the sag rail.

10. The support device of claim 8 wherein the sag rail comprises a friction-reducing material provided atop the sag rail along at least a portion of the top surface and configured to contact with a heated plastic sheet being carried there atop.

11. The support device of claim 10 wherein the sag rail comprises a vertically undulating top edge forming alternating concave and convex portions, the friction-reducing material provided along convex portions of the vertically undulating top edge and configured to contact a plastic sheet carried there along to reduce contact friction between the sheet and the convex portions of the sag rail.

12. The support device of claim 11 wherein the concave portions provide gaps between the sheet and the sag rail configured to enable thermal transfer through the gaps and between opposite sides of the sag rail.

13. The thermoforming web support apparatus of claim 8 wherein the sag rail comprises a longitudinally extending, substantially horizontal rail member having an undulating top support edge provided along a top margin of the rail member.

14. The thermoforming web support apparatus of claim 13 wherein the top support edge comprises a plurality of discrete support edges each comprising an elevated edge portion of the rail member.

15. The thermoforming web support apparatus of claim 14 further comprising a plurality of inset pieces affixed to the rail member along the top support edge, each of the inset pieces providing a respective one of the elevated edge portions.

16. The support device of claim 8 wherein the top surface comprises a plurality of discrete elevated portions configured to support the heated plastic sheet and a plurality of lowered portions each provided by the top surface forming a gap between each of a selected adjacent pair of the elevated portions.

17. A web support apparatus for a heated thermoformable web, comprising:

a support frame;

a pair of web guide rails carried by the frame in substantially horizontal and parallel relation along a web travel path;

a longitudinal track carried in substantially horizontal and parallel relation intermediate the pair of web guides to center support a web carried therebetween and having a relatively thin top edge extending along the web travel direction and configured to support the thermoformable web along a thin strip extending in a longitudinal web travel direction intermediate the pair of guide rails and provide an air gap beneath a remaining portion of the web between the track and each guide rail to prevent contact with the web from any support structures that might generate blemishes in the web; and a temperature regulator provided at least in part in the longitudinal track.

18. The web support apparatus of claim 17 wherein the track comprises an edge rail having an undulating top surface extending in the web travel direction.

19. The web support apparatus of claim 18 wherein the edge rail extends in a substantially horizontal, longitudinal direction.

20. The web support apparatus of claim 17 wherein the top surface is an undulating top surface having discrete contact portions spaced apart along the top surface.

21. The web support apparatus of claim 17 wherein the temperature regulator comprises at least one fluid channel provided within the edge rail and configured to receive a flow of temperature-regulating fluid to regulate temperature of the track within a determined temperature range.

22. The web support apparatus of claim 21 wherein the fluid channel comprises a lower fluid channel and an upper fluid channel communicating with the lower fluid channel, wherein the lower fluid channel and the upper fluid channel are configured to provide a fluid channel circuit through the longitudinal track.

23. The web support apparatus of claim 22 further comprising a heat exchanger communicating with the fluid channel via a fluid conduit, the heat exchanger configured to regulate temperature of fluid being delivered through the fluid channel via the conduit.

24. The web support apparatus of claim 23 further comprising a control system configured to controllably regulate heat transfer between the heat exchanger and the fluid to realize a desired temperature of the fluid being delivered through the fluid channel.

* * * * *